US005433502A

United States Patent [19]

Condorodis et al.

[11] Patent Number: 5,433,502

[45] Date of Patent: Jul. 18, 1995

[54] FOLDING CHAIR WITH INTEGRAL TRANSPORTATION TUBE

[76] Inventors: John P. Condorodis, 800 Marvin Rd., Ormond Beach, Fla. 32176; John H. McConnell, 1084 Shockway Dr., Ormond Beach, Fla. 32174; James M. Hodson, P.O. Box 351255, Palm Coast, Fla. 32135-1255

[21] Appl. No.: 217,708

[22] Filed: Mar. 25, 1994

[51] Int. Cl.[6] ..... A47C 4/00

[52] U.S. Cl. ..... 297/17; 297/45

[58] Field of Search ..... 297/17, 16.1, 16.2, 297/33, 47, 45, 59, 4, 440.22, 440.1; 224/155, 202, 242, 251, 257

[56] References Cited

U.S. PATENT DOCUMENTS

| | | | |
|---|---|---|---|
| 3,376,069 | 4/1968 | Lowdermilk | 297/17 X |
| 3,475,050 | 10/1969 | Leahy | 297/17 |
| 3,532,378 | 10/1970 | Dalia . | |
| 4,062,584 | 12/1977 | Pinkham et al. . | |
| 4,079,992 | 3/1978 | Thrift et al. . | |
| 4,541,666 | 9/1985 | Vanderminden . | |
| 4,605,261 | 8/1986 | Lee . | |
| 4,911,347 | 3/1990 | Wilhite | 224/202 X |
| 5,016,792 | 5/1991 | Jay | 297/17 X |
| 5,318,342 | 6/1994 | Hale | 297/17 X |

*Primary Examiner*—Laurie K. Cranmer
*Attorney, Agent, or Firm*—Paul S. Rooy

[57] ABSTRACT

A folding chair with integral transportation tube comprising a seat removably attached to a transportation tube and a base. The seat is a folding seat comprised of a pair of folding seat supports and a seat bottom and seat back attached to the seat supports. The transportation tube and base support the seat in the chair configuration. The seat folds to fit into the transportation tube with the base for transportation.

16 Claims, 6 Drawing Sheets

FIG 7
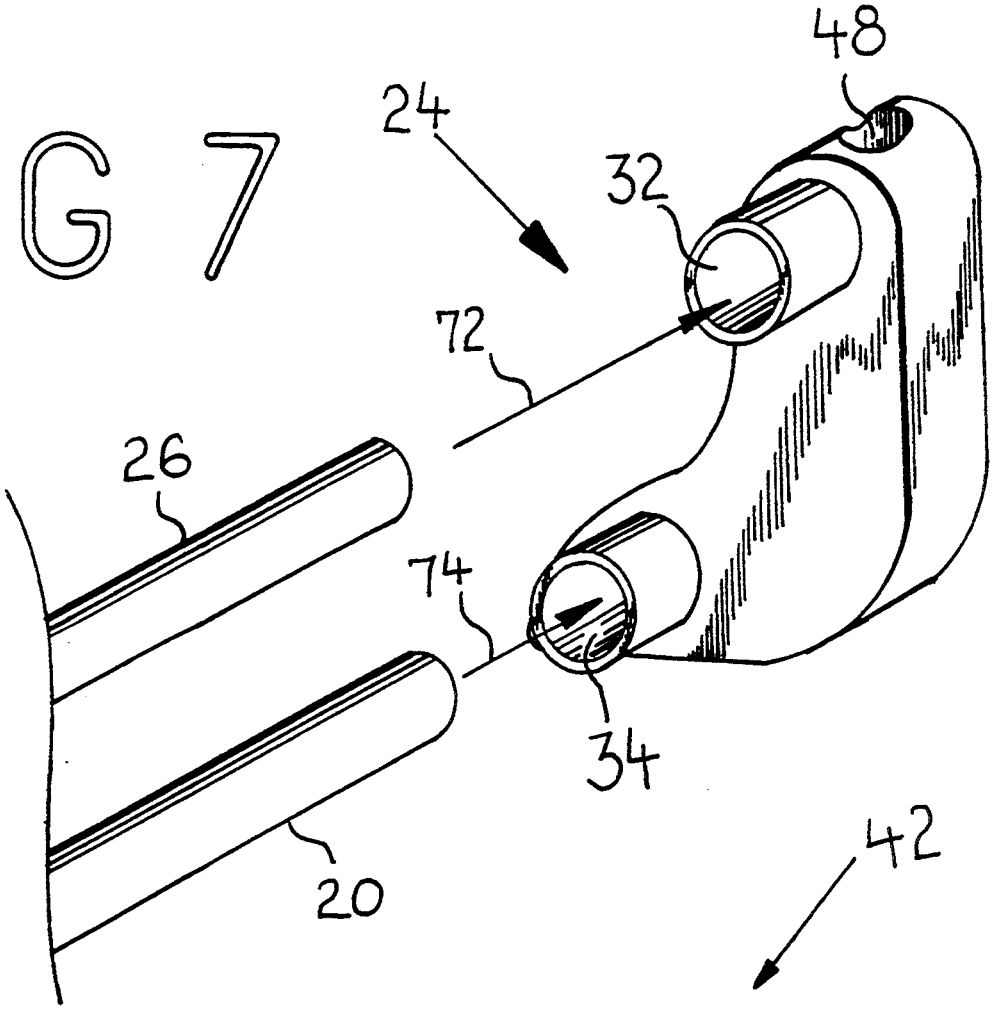
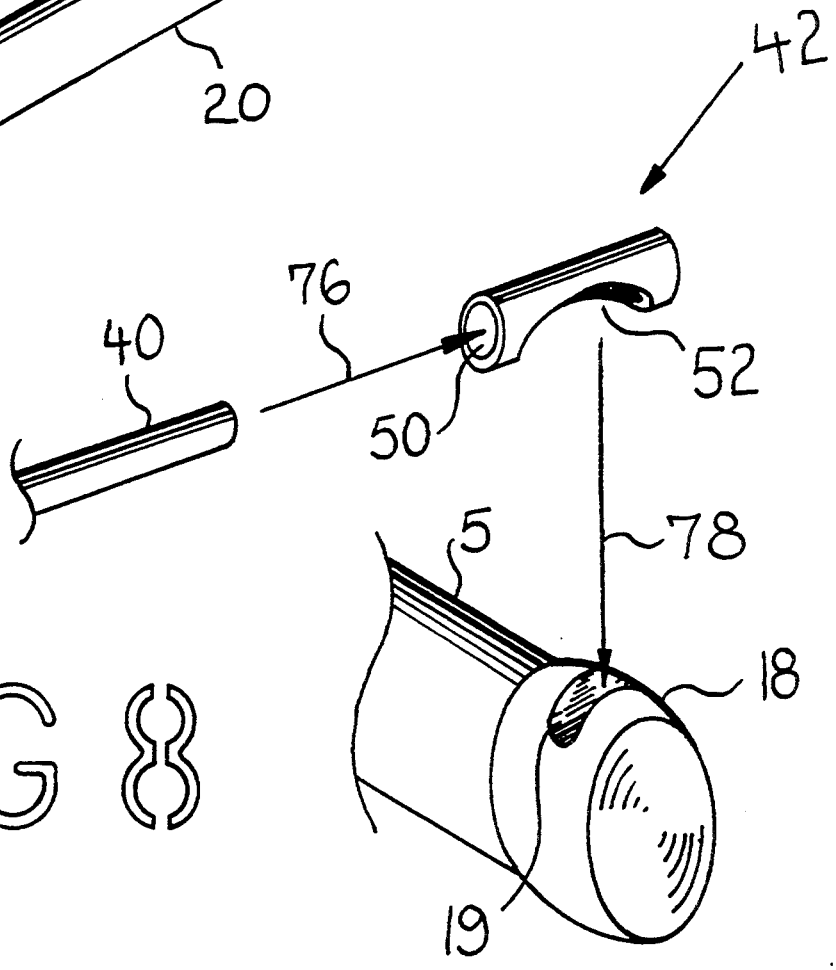
FIG 8

FOLDING CHAIR WITH INTEGRAL TRANSPORTATION TUBE

BACKGROUND OF THE INVENTION

1. Field of the Invention

The present invention relates to folding chairs and in particular to a folding chair with integral transportation tube.

2. Background

The outdoor chair industry is rapidly expanding due to America's increasing desire to be outdoors. Surveys have shown that more and more people are relocating to the nation's sunbelt regions and consequently are spending more time at beaches and other recreational areas.

Research has indicated that consumers' most frequent complaints are that beach chairs are cumbersome, not easily transportable and that they only last one season. These complaints stem from two major design flaws of the currently available outdoor folding chairs: 1. they are heavy, bulky and not designed with ease of carrying in mind, and 2. they are not constructed with materials which are capable of withstanding the rigors of sun and salt air.

The folding chair transportation problem is made worse if the distance to be travelled is great (as is frequently the case in California when carrying beach chairs from the parking lot to a Pacific Ocean beach) and when other supplies such as beach towels, sun block, reading materials, coolers, sun parasols, etc. must also be carried. A light folding chair capable of being carried in a hands-free manner would certainly make life easier.

Other problems associated with currently available folding chairs include the environmentally sensitive issue of the use of excessive packaging in the merchandising of these chairs, the chairs being blown over and the chairs sinking into the sand when occupied.

A few chairs are designed to be carried in storage bags; these bags tend to blow away and get lost when not in use.

Some folding chairs are designed to rest directly on the ground; if the ground is wet the occupant gets wet also.

Another problem of currently available folding chair designs is that the folding chair is sometimes damaged while in transit.

SUMMARY OF THE INVENTION

Accordingly, it is an object of this invention to provide a folding chair with integral transportation tube which is easy to transport in a hands-free fashion. Features allowing the accomplishment of this object include a base and folding seat which fit inside a transportation tube, and a strap which allows the transportation tube to be carried over the shoulder. In addition, the folding chair with integral transportation tube is manufactured to be light and compact (the entire folding chair with integral transportation tube weighs under 4 pounds; the transportation tube measures approximately 4 inches in diameter and 24 inches in length). Advantages associated with the accomplishment of this object include the ability to carry more items per trip, the reduction of the number of trips which must be made, convenience, and ease of transporting the folding chair with integral transportation tube.

Another object of this invention is to provide a folding chair with integral transportation tube which will last a long time. Features enabling the accomplishment of this object include the use of high quality, corrosion-resistant materials such as recycled PVC and aluminum, and an easily replaceable seat back and seat bottom. Advantages associated with the achievement of this object include cost savings and convenience.

Still another object of this invention is to provide a folding chair with integral transportation tube which does not require excessive packaging for point of purchase display. Features allowing this object to be accomplished include self-contained cylindrical packaging (the transportation tube) which may bear vivid and colorful descriptive markings, and transportation tubes which are stackable. Advantages associated with the accomplishment of this include preservation of scarce packaging materials such as plastics, cardboard, and styrofoam.

Another object of this invention is to provide a folding chair with integral transportation tube resistant to transportation damage. Features permitting this object to be achieved include a base and folding seat which fit inside a protective transportation tube. Advantages include a more durable chair along with consequent cost savings.

Still another object of this invention is to provide a folding chair with integral transportation tube resistant to carrying container loss. A feature which allows this object to be accomplished is a transportation tube integral to the assembled chair. As the transportation tube forms part of the assembled chair, it is prevented from being blown away or otherwise lost, providing the advantages of convenience and cost savings.

Another object of this invention is to provide a folding chair with integral transportation tube whose seat bottom does not rest on the ground, thereby affording the advantage of keeping its occupant dry even in the presence of wet ground.

Still a further object of this invention is to provide a folding chair with integral transportation tube which will not sink into soft sand by virtue of features such as a base containing upper and lower rods, and the transportation tube to provide a wide support footprint. Advantages associated with the accomplishment of this object include comfort and convenience.

Still a further object of this invention is to provide a folding chair with integral transportation tube which resists being blown down in the presence of wind. A feature allowing this object to be accomplished is the inclusion of a transportation tube as a seat support. Advantages associated with the accomplishment of this object include a more stable seat and the comfort and convenience associated with a more stable seat.

Further objects of this invention include providing a folding chair with integral transportation tube which lends itself readily to the promotion of cylindrical items, sets up quickly, is aesthetically pleasing and can be manufactured of recylceable materials such as plastic, aluminum, etc.

BRIEF DESCRIPTION OF THE DRAWINGS

The invention, together with the other objects, features, aspects and advantages thereof will be more clearly understood from the following in conjunction with the accompanying drawings.

Six sheets of drawings are provided. Sheet one contains FIGS. 1, 2 and 3. Sheet two contains FIGS. 4, 5 and 6. Sheet three contains FIGS. 7 and 8. Sheet four contains FIGS. 9, 10, 11 and 12. Sheet five contains FIGS. 13, 14, 15, 16 and 17. Sheet six contains FIG. 18.

Figure 1:
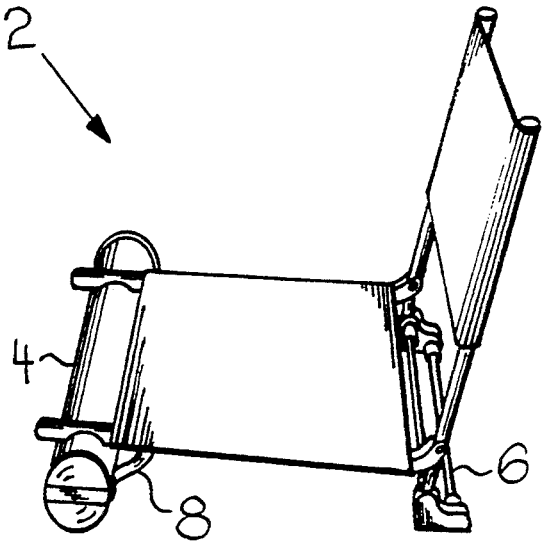

FIG. 1 is a side isometric view of the folding chair with integral transportation tube.

Figure 2:
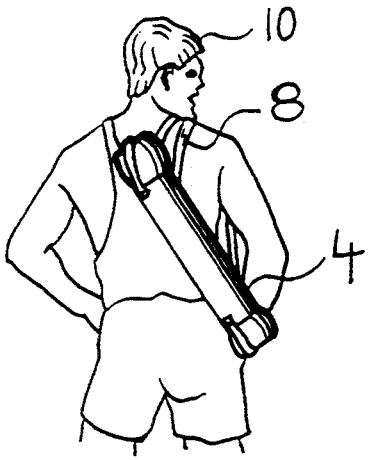

FIG. 2 is a rear isometric view of a pedestrian carrying a folding chair with integral transportation tube over his shoulder by using the strap.

Figure 3:
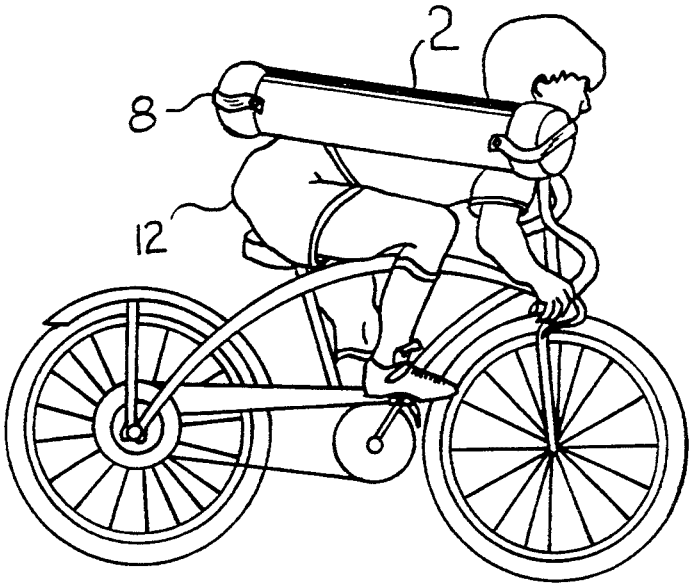

FIG. 3 is a side isometric view of a cyclist carrying a folding chair with integral transportation tube over his shoulder by using the strap.

Figure 4:
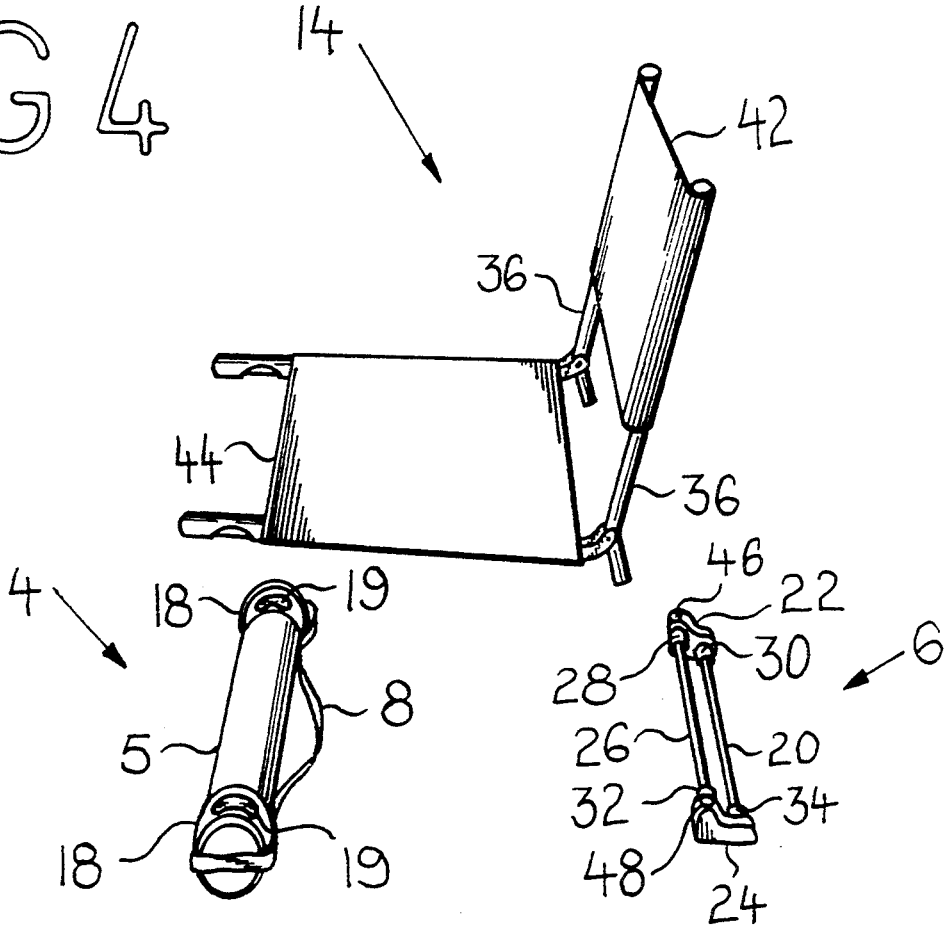

FIG. 4 is a side isometric view of a folding chair with integral transportation tube with the three basic components separated.

Figure 5:
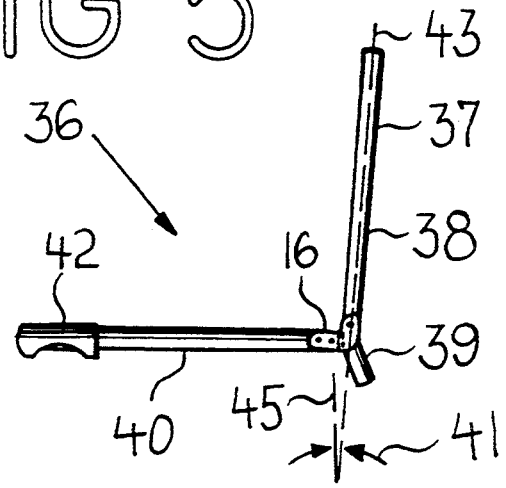

FIG. 5 is a side view of a seat support.

Figure 6:
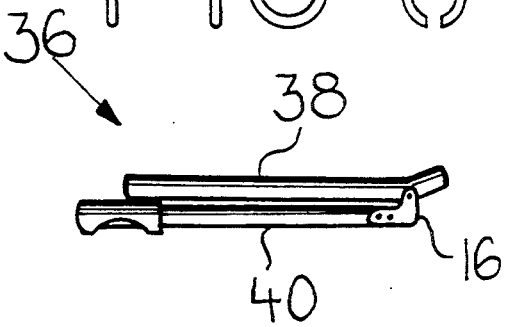

FIG. 6 is a side view of a folded seat support.

FIG. 7 is a front isometric detail of an upper rod and a lower rod being assembled into the second base end, FIG. 8 is a rear isometric detail of the way a horizontal member snaps into a tube end.

Figure 9:
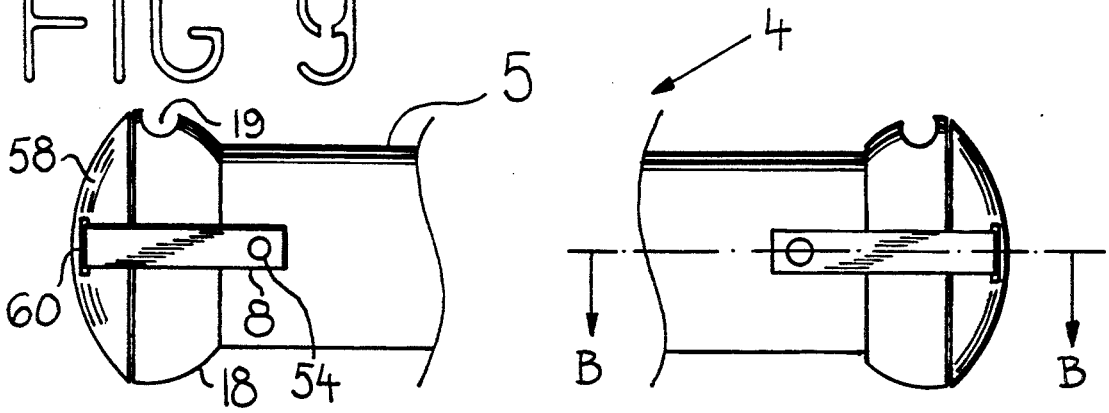

FIG. 9 is a side view of a transportation tube.

Figure 10:
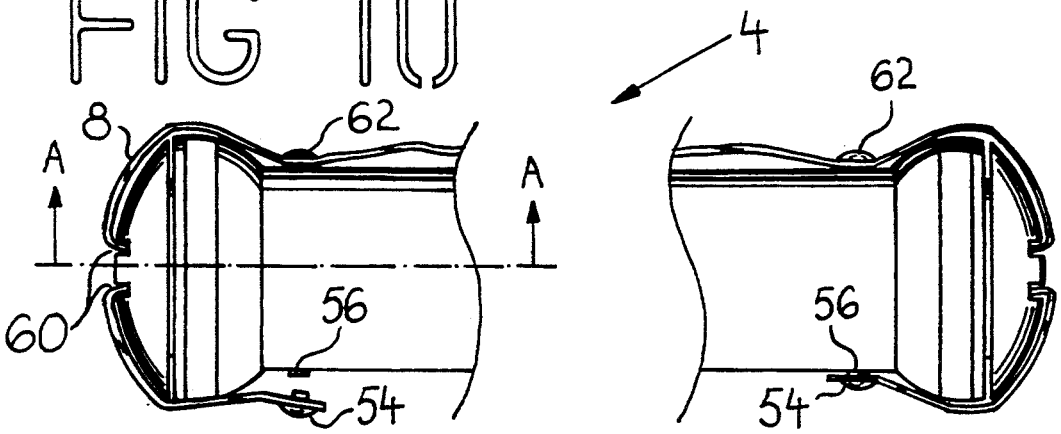

FIG. 10 is a top view of a transportation tube.

Figure 11:
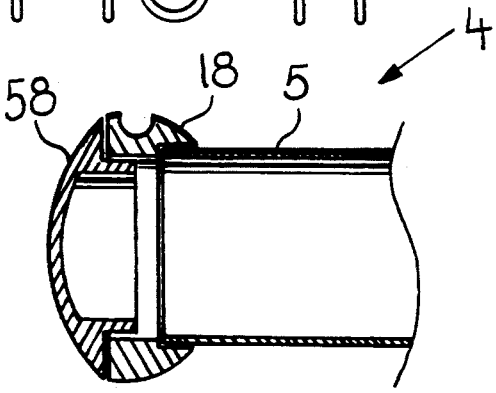

FIG. 11 is a cross sectional side view of a transportation tube taken at section A—A of FIG. 10.

Figure 12:
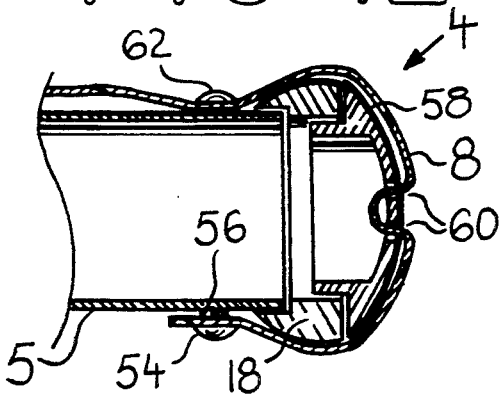

FIG. 12 is a cross sectional top view of a transportation tube taken at section B—B of FIG. 9.

Figure 13:
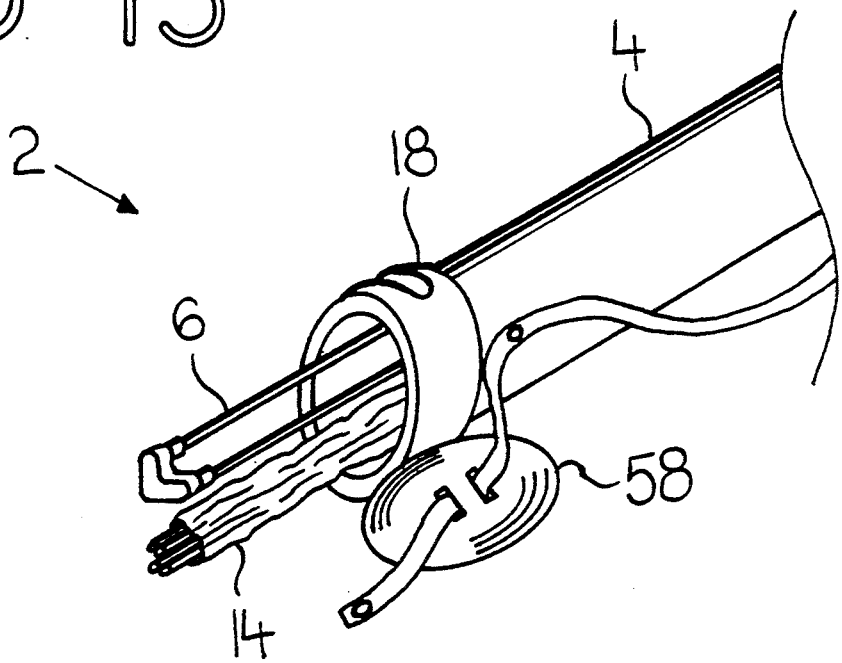

FIG. 13 is a side isometric view of a folding chair with integral transportation tube showing how the base and folded seat fit into the transportation tube.

FIGS. 14–17 show how the seat folds in order to fit into the transportation tube.

Figure 18:
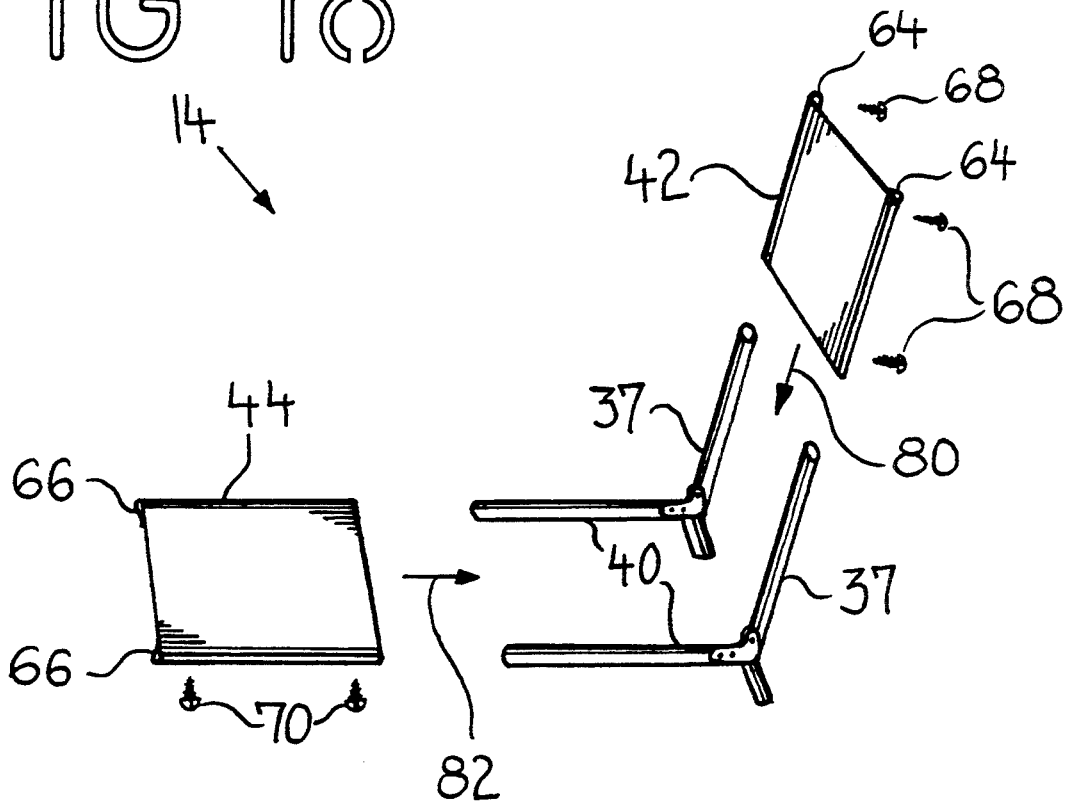

FIG. 18 is a side isometric view of a seat showing how seat back and seat bottom may be quickly and easily replaced.

COMPLETE DESCRIPTION OF THE PREFERRED EMBODIMENT

Referring now to FIG. 1 we see a side isometric view of folding chair with integral transportation tube 2 in the chair configuration. Folding chair with integral transportation tube 2 is supported on transportation tube 4 and base 6.

FIG. 2 is a rear isometric view of folding chair with integral transportation tube 2 in the carrying configuration: all components other than the transportation tube 4 are contained within transportation tube 4. Strap 8 is attached to transportation tube 4 and may be used to carry folding chair with integral transportation tube 2 over the shoulder of pedestrian 10, thereby freeing the hands of pedestrian 10.

FIG. 3 is a side isometric view of cyclist 12 carrying folding chair with integral transportation tube 2 over his shoulder by means of strap 8.

FIG. 4 is a side isometric view of the three main components of folding chair with integral transportation tube 2: seat 14, transportation tube 4 and base 6.

Seat 14 is comprised of two seat supports 36 to which a seat back 42 and a seat bottom 44 are attached.

FIG. 5 shows the components of each seat support 36: vertical member 38 is pivotally attached to horizontal member 40 by means of hinges 16. Vertical member 38 is comprised of seat back support 37 rigidly attached to leg 39.

When seat support 36 is in the unfolded position, as depicted in FIG. 5, the end of horizontal member 40 which is attached to hinges 16 butts up against vertical member 38, thereby fixing the angle between horizontal member 40 and seat back support 37.

Seat end 42 is installed over the end of horizontal member 40 opposite hinges 16.

It has been found that the ergonomically optimum angle 41 between the vertical 45 and seat back support centerline 43 is 5 degrees.

FIG. 6 shows a seat support 36 in the folded position. Vertical member 38 has been pivoted about hinge 16 until roughly parallel to horizontal member 40.

Referring back to FIG. 4, the second main component of folding chair with integral transportation tube 2 is transportation tube 4. Transportation tube 4 comprises a tube end 18 with tube end mouth 19 attached to each end of tube 5; strap 8 is attached to tube 5.

Base 6 is comprised of first base end 22 attached to second base end 24 by means of upper rod 26 and lower rod 20.

First base end 22 is comprised of first base end seat support aperture 46 sized to admit passage to leg 39, first base end upper aperture 28 sized to admit passage to one end of upper rod 26, and first base end lower aperture 30 sized to admit passage to one end of lower rod 20.

Second base end 24 is comprised of second base end seat support aperture 48 sized to admit passage to leg 39, second base end upper aperture 32 sized to admit passage to one end of upper rod 26, and second base end lower aperture 34 sized to admit passage to one end of lower rod 20.

FIG. 7 is a front isometric detail of a typical attachment of upper rod 26 and lower rod 20 to a base end—in this case second base end 24.

Second base end upper aperture 32 is sized to admit passage to one end of upper rod 26 as indicated by arrow 72. Upper rod 26 may be glued, staked or otherwise be permanently fixed within second base end upper aperture 32.

Second base end lower aperture 34 is sized to admit passage to one end of lower rod 20 as indicated by arrow 74. Lower rod 20 may be glued, staked or otherwise be permanently fixed within second base end lower aperture 34.

FIG. 8 is a rear isometric view depicting the manner of attachment of seat end 42 over horizontal member 40, and the subsequent assembly of horizontal member 40 into tube end mouth 19 during the chair erection procedure.

The end of horizontal member 40 opposite hinges 16 is inserted into seat end bore 50 as indicated by arrow 76. Seat end 42 may be glued, staked or otherwise permanently attached to horizontal member 40.

During the chair erection procedure, the end of horizontal member 40 to which seat end 42 is attached is snapped into tube end mouth 19 as indicated by arrow 78. Tube end mouth 19 is sized to frictionally admit passage to horizontal member 40.

Seat end mouth 52 is sized to conform to the outside shape of tube end 18.

In this manner, when folding chair with integral transportation tube 2 is in the chair configuration, seat end mouth 52 locates horizontal member 40 on transportation tube 4, and tube end mouth 19 locates transportation tube 4 relative to horizontal member 40.

FIG. 9 is a side view of transportation tube 4. Tube end 18 is attached to tube 5. End cap 58 removably fits into tube end 18, and is held in place by means of strap 8.

FIG. 10 is a top view of transportation tube 4. Strap 8 is permanently attached to one side of tube 5 by means of fastener 62, and removably attached to the opposite side of tube 5 by means of male snap 54 attached to strap 8 and female snap 56 attached to tube 5.

FIG. 11 is a side cross sectional view of transportation tube 4 taken at section A—A of FIG. 10. End cap 58 fits into tube end 18. Tube end 18 is attached to tube 5.

FIG. 12 is a top cross sectional view of transportation tube 4 taken at section B—B of FIG. 9. Strap 8 is permanently attached to tube 5 by means of fastener 62. Strap 8 loops through end cap apertures 60 and then is removably attached to the side of tube 5 opposite fastener 62 by means of male snap 54 and female snap 56.

FIGS. 14–17 show how seat 14 folds in order to fit into transportation tube 4 for transport.

Figure 14:
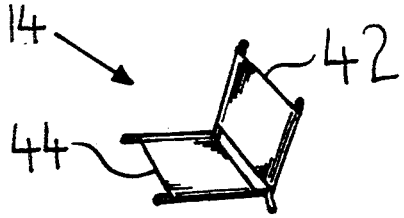

FIG. 14 shows seat 14 after horizontal members 40 have been unsnapped from tube end mouths 19 and legs 39 have been removed from first base end seat support aperture 46 and second base end seat support aperture 48.

Figure 15:
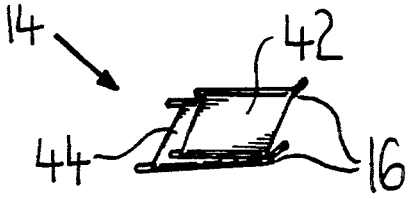

FIG. 15 shows vertical members 38 pivoted down about hinges 16 so as to bring seat back 42 adjacent seat bottom 44.

Figure 16:
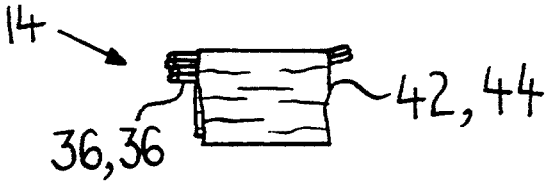

FIG. 16 depicts the two folded seat supports 36 side by side, with seat back 42 and seat bottom 44 ready to be wrapped around them.

Figure 17:
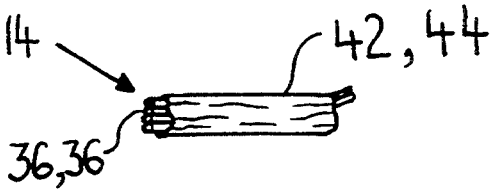

FIG. 17 shows seat back 42 and seat bottom 44 wrapped around seat supports 36. Seat 14 is now ready to be inserted into transportation tube 4 along with base 6, as shown in FIG. 13.

Seat back 42 and seat bottom 44 may be fabricated of canvas, synthetic fabric or other appropriate material. Seat supports 36, base 6 and most of transportation tube 4 may be fabricated of recycled PVC, plastic or other appropriate materials. Hinges 16 fastener 62, male snap 54 and female snap 56 may be manufactured of corrosion resistant aluminum, stainless steel or other appropriate material. Strap 8 may be made of synthetic material or other appropriate material.

Chair Erecting Procedure

A. Remove male snap 54 from female snap 56.

B. Remove end cap 58 from tube end 18 as shown in FIG. 13.

C. Remove base 6 and seat 14 from transportation tube 4.

D. Replace end cap 58 in tube end 18 by reversing steps A and B above.

E. Unfold seat 14 by reversing the steps depicted in FIGS. 14–17.

F. Insert one leg 39 into first base end seat support aperture 46 and the other leg 39 into second base end seat support aperture 48.

G. Snap one horizontal member 40 into each tube end mouth 19 such that each tube end 18 is located within the corresponding seat end mouth 52.

Chair Collapsing Procedure For Transportation

A. Reverse steps A–G above in Chair Erecting Procedure.

Seat Back 42 and Seat Bottom 44 Replacement

Seat back 42 and seat bottom 44 may be quickly and easily replaced as shown in FIG. 18.

To replace seat back 42, simply slide seat back supports 37 out of seat back sleeves 64, then slide seat back supports 37 into the corresponding seat back sleeves 64 of the new seat back 42 as indicated by arrow 80. In the presence of optional screws 68, unscrew and remove screws 68 prior to beginning the replacement operation, and replace screws 68 after the new seat back 42 is in place.

To replace seat bottom 44, simply slide horizontal members 40 out of seat bottom sleeves 66, then slide horizontal members 40 into the corresponding seat bottom sleeves 66 of the new seat bottom 44 as indicated by arrow 82. In the presence of optional screws 70, unscrew and remove screws 70 prior to beginning the replacement operation, and replace screws 70 after the new seat bottom 44 is in place.

While a preferred embodiment of the invention has been illustrated herein, it is to be understood that changes and variations may be made by those skilled in the art without departing from the spirit and scope of the appending claims.

DRAWING ITEM INDEX

2 folding chair with integral transportation tube
4 transportation tube
5 tube 6 base
8 strap
10 pedestrian
12 cyclist
14 seat
16 hinges
18 tube end
19 tube end mouth
20 lower rod
22 first base end
24 second base end
26 upper rod
28 first base end upper aperture
30 first base end lower aperture
32 second base end upper aperture
34 second base end lower aperture
36 seat support
37 seat back support
38 vertical member
39 leg
40 horizontal member
41 angle
42 seat back
43 seat back support centerline
44 seat bottom
45 vertical
46 first base end seat support aperture
48 second base end seat support aperture
50 seat end bore
52 seat end mouth
54 male snap
56 female snap
58 end cap
60 end cap aperture
62 fastener
64 seat back sleeve
66 seat bottom sleeve
68 screw
70 screw
72 arrow
74 arrow
76 arrow
78 arrow
80 arrow
82 arrow

We claim:

1. A folding chair with integral transportation robe comprising:
a seat,
a transportation tube, whereby said seat and a base may be efficiently stored and transported,
a first means of removably attaching said seat to said transportation tube,
said base, and
a second means of removably attaching said seat to said base.

2. The folding chair with integral transportation tube of claim 1 wherein said seat is comprised of:
two seat supports,
a seat back attached to said seat supports, and
a seat bottom attached to said seat supports.

3. The folding chair with integral transportation tube of claim 2 wherein each said seat support is comprised of:
a vertical member comprised of a seat back support rigidly attached to a leg,
a horizontal member,
hinges pivotally attaching one end of said horizontal member to said vertical member, and
a seat end attached to the end of said horizontal member opposite said hinges.

4. The folding chair with integral transportation tube of claim 3 wherein said seat end comprises a seat end bore and a seat end mouth.

5. The folding chair with integral transportation tube of claim 3 wherein said seat bottom further comprises two seat bottom sleeves, each said seat bottom sleeve being sized to admit passage to one said horizontal member.

6. The folding chair with integral transportation tube of claim 3 wherein said second means of removably attaching said seat to said base comprises:
a first base end seat support aperture sized to admit one said leg, and
a second base end seat support aperture sized to admit the other said leg.

7. The folding chair with integral transportation tube of claim 2 wherein said seat back further comprises two seat back sleeves, each said seat back sleeve being sized to admit passage to one vertical member.

8. The folding chair with integral transportation tube of claim 1 wherein said transportation tube is comprised of:
a tube,
a tube end attached to each end of said tube,
an end cap removably fitted into each said tube ends, and
a strap attached to said tube and said end caps.

9. The folding chair with integral transportation tube of claim 8 wherein each said tube ends further comprises a tube end mouth.

10. The folding chair with integral transportation tube of claim 9 wherein the means of attaching said strap to said tube comprises:
a fastener on one side of said tube,
a female snap attached to the other side of said tube, and
a male snap attached to said strap.

11. The folding chair with integral transportation tube of claim 10 wherein the means of attaching each said end cap to said strap comprises end cap apertures through which said strap is threaded.

12. The folding chair with integral transportation tube of claim 1 wherein said base is comprised of:
a first base end,
a second base end,
an upper rod attached at one end to said first base end and at its other end to said second base end,
a lower rod attached at one end to said first base end and at its other end to said second base end.

13. The folding chair with integral transportation tube of claim 12 wherein said first base end further comprises:
a first base end lower aperture sized to admit one end of said lower rod,
a first base end upper aperture sized to admit one end of said upper rod, and
a first base end seat support aperture,
and said second base end further comprises:
a second base end lower aperture sized to admit one end of said lower rod,
a second base end upper end aperture sized to admit one end of said upper rod, and
a second base end seat support aperture.

14. The folding chair with integral transportation tube of claim 1 wherein said first means of removably attaching said seat to said transportation tube comprises:
said seat further comprising two horizontal members, each said horizontal member having a seat and having a seat end mouth attached at one end,
said transportation tube further comprising a tube having a tube end attached at each end of said tube, each said tube end having a tube end mouth, each said tube end mouth being sized to frictionally admit the end of one said horizontal member to which said seat end is attached, said seat end mouth being sized to admit part of said tube end, thereby locating said horizontal member relative to said transportation tube.

15. A folding chair with integral transportation tube comprising:
a seat comprising two legs and two horizontal members,
a transportation tube having a tube end mouth at each end, each said tube end mouths being sized to frictionally admit one said horizontal member, one end of one said horizontal member being removably disposed within one said tube end mouth and one end of the other said horizontal member being removably disposed within the other said tube end mouth, and
a base comprising a first base end seat support aperture sized to admit one said leg, and a second base end seat support aperture sized to admit the other said leg, one said leg being removably disposed within said first base end seat support aperture and the other said leg being removably disposed within said second base end seat support aperture.

16. The folding chair with integral transportation tube of claim 15 wherein said seat further comprises two seat back supports, each said seat back support having a seat back support centerline, the angle between each said seat back support centerline and a vertical line being 5 degrees ±2 degrees.

* * * * *

UNITED STATES PATENT AND TRADEMARK OFFICE

CERTIFICATE OF CORRECTION

PATENT NO. : 5,433,502

DATED : July 18, 1995

INVENTOR(S) : John Condorodis, et al

It is certified that error appears in the above-indentified patent and that said Letters Patent is hereby corrected as shown below:

Col. 3, line 18, change 'base end,' to ----base end.----

Col. 7, line 1, change 'transportation robe' to ----transportation tube----

Col. 8, line 30, change 'seat and' to ----seat end----

Signed and Sealed this

Sixteenth Day of January, 1996

*Attest:*

*Attesting Officer*

BRUCE LEHMAN

*Commissioner of Patents and Trademarks*